US009685106B2

(12) United States Patent
Cha

(10) Patent No.: US 9,685,106 B2
(45) Date of Patent: Jun. 20, 2017

(54) METHOD FOR COMPENSATING IMAGE DISTORTION CAUSED BY THE CURVATURE OF A DISPLAY DEVICE

(71) Applicant: Samsung Display Co., Ltd., Yongin, Gyeonggi-Do (KR)

(72) Inventor: Ui Yeong Cha, Hwaseong-si (KR)

(73) Assignee: Samsung Display Co., Ltd. (KR)

( * ) Notice: Subject to any disclaimer, the term of this patent is extended or adjusted under 35 U.S.C. 154(b) by 27 days.

(21) Appl. No.: 14/807,799

(22) Filed: Jul. 23, 2015

(65) Prior Publication Data

US 2016/0196778 A1 Jul. 7, 2016

(30) Foreign Application Priority Data

Jan. 6, 2015 (KR) ..... 10-2015-0001276

(51) Int. Cl.
*G09G 3/20* (2006.01)

(52) U.S. Cl.
CPC ..... *G09G 3/20* (2013.01); *G09G 2320/0233* (2013.01); *G09G 2320/0285* (2013.01); *G09G 2320/045* (2013.01); *G09G 2360/145* (2013.01)

(58) Field of Classification Search
CPC ..... G09G 2380/02; G09G 2320/0233; G06F 1/1652; H04M 1/0268
See application file for complete search history.

(56) References Cited

U.S. PATENT DOCUMENTS

2005/0264149 A1* 12/2005 Cok ..... G01J 1/4228 313/110
2008/0062164 A1* 3/2008 Bassi ..... H04N 9/3147 345/214
2008/0170004 A1* 7/2008 Jung ..... G09G 3/3233 345/76
2012/0235893 A1* 9/2012 Phillips ..... G06F 3/012 345/156
2012/0235894 A1* 9/2012 Phillips ..... G09G 3/36 345/156
2013/0135366 A1* 5/2013 Araki ..... G09G 3/3607 345/690

(Continued)

FOREIGN PATENT DOCUMENTS

KR 10-2007-0064062 A 6/2007
KR 10-2012-0135657 A 12/2012
KR 10-2014-0054747 A 5/2014

*Primary Examiner* — Chanh Nguyen
*Assistant Examiner* — Navin Lingaraju
(74) *Attorney, Agent, or Firm* — Innovation Counsel LLP

(57) ABSTRACT

Disclosed are a curved display device and a driving method therefor. The curved display device includes: a display panel including a curved portion and a flat portion; a luminance compensator configured to determine a first luminance compensating value for the flat portion and to determine a second luminance compensating value for one or more positions of the curved portion; and a signal controller for adjusting an input image signal corresponding to the first and second luminance compensating values set by the luminance compensator so as to compensate luminance of those portions of the input image signal corresponding to both the curved portion and the flat portion of the display panel, and for transmitting the compensated image signal to the display panel.

14 Claims, 6 Drawing Sheets

(56) References Cited

U.S. PATENT DOCUMENTS

| | | | | |
|---|---|---|---|---|
| 2014/0002975 | A1* | 1/2014 | Lee | H05K 5/0017 361/679.01 |
| 2014/0126902 | A1 | 5/2014 | Swanson et al. | |
| 2014/0267091 | A1* | 9/2014 | Kim | G06F 1/1652 345/173 |
| 2014/0306985 | A1* | 10/2014 | Jeong | G09G 3/3233 345/601 |
| 2014/0320543 | A1* | 10/2014 | Oh | H01L 27/326 345/690 |
| 2014/0362126 | A1* | 12/2014 | Jeong | G09G 3/3233 345/690 |
| 2015/0379922 | A1* | 12/2015 | Zhang | G09G 3/3208 345/690 |
| 2016/0071457 | A1* | 3/2016 | Kim | G09G 3/2003 345/690 |
| 2016/0100158 | A1* | 4/2016 | Chen | G09G 5/00 345/156 |
| 2016/0117994 | A1* | 4/2016 | Lee | G09G 3/3406 345/694 |
| 2016/0148554 | A1* | 5/2016 | Lim | G09G 3/20 345/694 |
| 2016/0205391 | A1* | 7/2016 | Kim | H04N 13/0468 348/51 |
| 2016/0210901 | A1* | 7/2016 | Cha | G09G 3/3258 |

* cited by examiner

METHOD FOR COMPENSATING IMAGE DISTORTION CAUSED BY THE CURVATURE OF A DISPLAY DEVICE

CROSS-REFERENCE TO RELATED APPLICATION

This application claims priority to, and the benefit of, Korean Patent Application No. 10-2015-0001276 filed in the Korean Intellectual Property Office on Jan. 6, 2015, the entire contents of which are incorporated herein by reference.

BACKGROUND (a) Field

Embodiments of the present invention relate generally to display devices and associated driving methods. More particularly, embodiments of the present invention relate to curved display devices and associated driving methods.

(b) Description of the Related Art

Flat panel displays have seen recent wide acceptance. Some examples of flat panel displays include a liquid crystal display, an organic electro-luminescence display device, a plasma display device, and a field emission display.

The organic light emitting device may be driven with a low voltage, may be manufactured to be thin, and may have a wide viewing angle and a high response rate. Thus, it may be advantageous for use in display devices such as a portable phone, a car audio system, or a digital camera.

The organic light emitting diode (OLED) display uses an organic light emitting diode (OLED) in which luminance is controlled by a current or a voltage. The organic light emitting diode includes an anode layer and a cathode layer for forming an electric field, and an organic light emitting material emitting light in response to application of the electric field.

Generally, the organic light emitting diode display is classified as a passive matrix OLED (PMOLED) or an active matrix OLED (AMOLED) depending on the manner of its driving.

Between the PMOLED and AMOLED, the AMOLED is generally more popular due to its superior resolution, contrast, and operation speed. One frame for the AMOLED includes a scanning period when image data is written, and a light emitting period when light is emitted in accordance with the written image data.

However, in OLED displays, different pixels sometimes exhibit different characteristics such as operation voltage Vth and mobility of their driving transistors, due to process deviation and the like. This results in a difference in luminance between different pixels. The organic light emitting device may be implemented as a curved panel, so it has gained recent popularity. However, organic light emitting devices implemented as curved panels can suffer from luminance deviation caused by the curvature of the panel.

The above information disclosed in this Background section is only for enhancement of understanding of the background of the invention and therefore may contain information not in the prior art that is already known to a person of ordinary skill in the art.

SUMMARY

Embodiments of the present invention provide a display device for compensating luminance deviation, and a driving method therefor.

An exemplary embodiment of the present invention provides a curved display device including: a display panel including a curved portion and a flat portion; a luminance compensator configured to determine a first luminance compensating value for the flat portion and to determine a second luminance compensating value for one or more positions of the curved portion; and a signal controller for adjusting an input image signal corresponding to the first and second luminance compensating values set by the luminance compensator so as to compensate luminance of those portions of the input image signal corresponding to both the curved portion and the flat portion of the display panel, and for transmitting the compensated image signal to the display panel.

The luminance compensator may be configured to receive data derived from an image captured by a photographing unit, and may determine the second luminance compensating value according to the data corresponding to the curved portion and a radius of curvature of the curved portion.

A radius of curvature of the curved portion may be substantially constant across the curved portion, and the second luminance compensating value may have a first value corresponding to that part of the curved portion that is proximate to the flat portion, and may have a second value corresponding to that part of the curved portion that is remote from the flat portion, the second value being smaller than the first value.

The curved portion may include a first portion having a first radius of curvature and a second portion having a second radius of curvature, the first radius of curvature being greater than the second radius of curvature, wherein the first portion is positioned closer to the flat portion than the second portion.

The second luminance compensating value may comprise a first value corresponding to the first portion and a second value corresponding to the second portion, the first value being less than the second value.

Determined ones of the second luminance compensating value may increase with corresponding distance from the flat portion.

Another embodiment of the present invention provides a method for driving a curved display device, the device including a display panel with a curved portion and a flat portion and a driver for driving the display panel, the method including: setting a first luminance compensating value corresponding to the flat portion; setting a second luminance compensating value corresponding to respective positions of the curved portion; adjusting an input image signal according to the first luminance compensating value and the second luminance compensating value, so as to form an adjusted image signal; and applying the adjusted image signal to the display panel.

According to embodiments of the present invention, luminance deviation of a curved panel may be compensated by compensating the luminance according to a degree of curvature of the panel.

Further, according to exemplary embodiments of the present invention, luminance deviation caused by even highly curved panels may be compensated.

Figure 1:
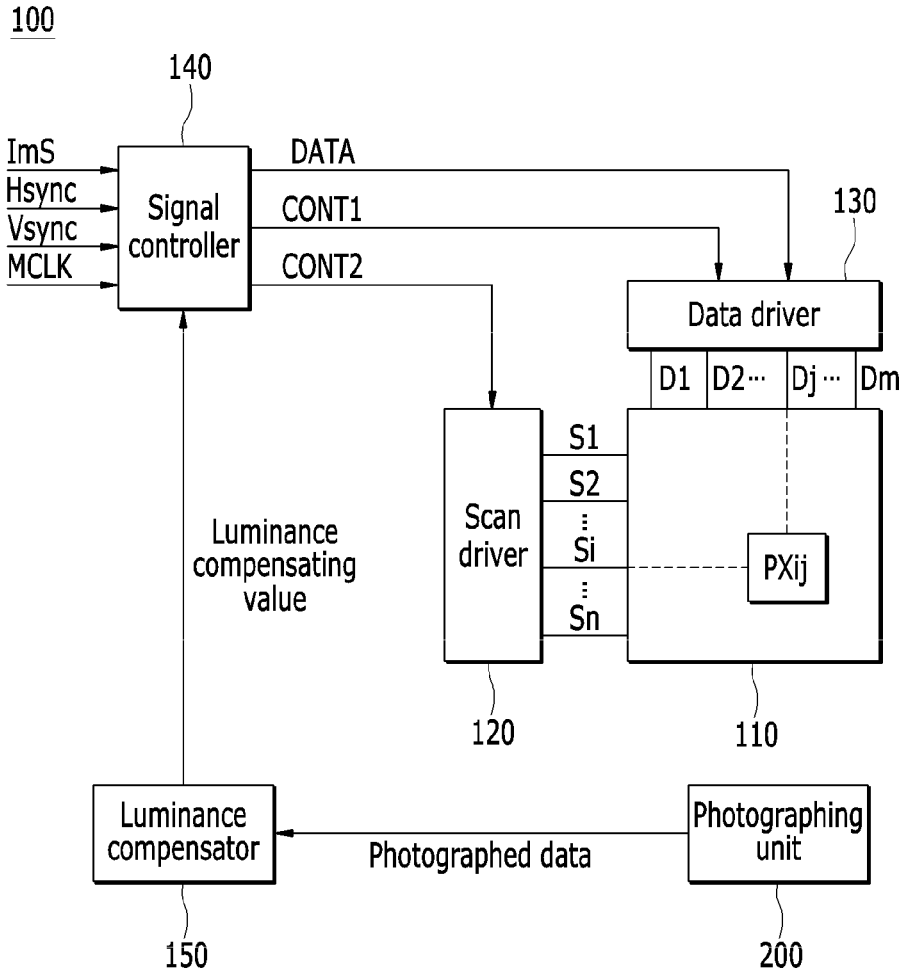
FIG. 1 shows a display device according to an exemplary embodiment of the present invention.

The various Figures are not to scale.

DETAILED DESCRIPTION OF THE EMBODIMENTS

In the following detailed description, only certain exemplary embodiments of the present invention have been shown and described, simply by way of illustration. As those skilled in the art would realize, the described embodiments may be modified in various different ways, all without departing from the spirit or scope of the present invention. All numerical values are approximate, and may vary.

Furthermore, with exemplary embodiments of the present invention, detailed description is made as to the constituent elements in one exemplary embodiment with reference to the relevant drawings by using the same reference numerals for the same constituent elements, while only the constituent elements different from those related to the one exemplary embodiment are described in other exemplary embodiments.

Parts that are unrelated to the description of the exemplary embodiments are not shown to make the description clear, and like reference numerals designate like element throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

A curved organic light emitting device according to an exemplary embodiment of the present invention will now be described with reference to accompanying drawings. An organic electric field emissive display device will be described for an example of the curved display device, the present invention is not restricted thereto, and it is applicable to other types of curved display devices such as a liquid crystal display.

FIG. 1 shows a display device 100 according to an exemplary embodiment of the present invention.

As shown in FIG. 1, the display device 100 includes a display panel 110, a scan driver 120, a data driver 130, a signal controller 140, and a luminance compensator 150.

The display panel 110 includes a plurality of pixels ($PX_{ij}$) each connected to a corresponding scan line from among a plurality of scan lines (S1-Sn) and a corresponding data line from among a plurality of data lines (D1-Dm). The pixels respectively display an image corresponding to an image data signal transmitted to the corresponding pixel.

The pixels included in the display panel 110 are connected to the scan lines (S1-Sn) and the data lines (D1-Dm) and are substantially arranged in a matrix form. The scan lines (S1-Sn) are substantially extended in a row direction and are substantially parallel with each other. The data lines (D1-Dm) are substantially extended in a column direction and are substantially parallel with each other. The pixels respectively receive power voltages including a first driving voltage (ELVDD) and a second driving voltage (ELVSS) from a power voltage supplier (not shown).

The display panel 110 may be flat or curved.

The scan driver 120 is connected to the display panel 110 through the scan lines (S1-Sn). The scan driver 120 generates a plurality of scanning signals for activating the respective pixels of the display panel 110 according to a scan control signal CONT2, and transmits the scanning signals to the corresponding scan lines (S1-Sn).

The scan control signal CONT2 is an operation control signal for the scan driver 120 that is generated and transmitted by the signal controller 140. The scan control signal CONT2 may include a scanning start signal and a clock signal. The scanning start signal generates a first scanning signal for displaying an image of one frame. The clock signal is a synchronization signal for sequentially applying scanning signals to a plurality of scan lines (S1-Sn).

The scan driver 120 generates a plurality of scanning signals (S[1]-S[n]) according to the scan control signal CONT2. The scan driver 120 may sequentially apply scanning signals (S[1]-S[n]), that each comprise a gate-on voltage, to a plurality of scan lines.

The data driver 130 is connected to the respective pixels of the display panel 110 through a plurality of data lines (D1-Dm). The data driver 130 receives an image data signal (DATA) and transmits the same to individual data lines (D1-Dm) according to a data control signal CONT1.

The data control signal CONT1 is an operation control signal for the data driver 130 that is generated and transmitted by the signal controller 140.

The data driver 130 selects a gray voltage corresponding to the image data signal (DATA) and transmits the same as a data signal to a plurality of data lines (D1-Dm).

The signal controller 140 receives an image signal (ImS) and an input control signal for controlling the display of the image signal (ImS). The image signal (ImS) includes luminance information for the respective pixels of the display unit 10, and luminance may be distinguished by a predetermined number (e.g., 1024, 256, or 64) of grays.

Examples of the input control signal transmitted to the signal controller 140 are a vertical synchronization signal Vsync, a horizontal synchronization signal Hsync, and a main clock signal MCLK.

The signal controller 140 generates first and second driving control signals CONT1 and CONT2 and an image data signal (DATA) according to the image signal (ImS), the horizontal synchronizing signal Hsync, the vertical synchronization signal Vsync, and the main clock signal MCLK.

The signal controller 140 uses the image signal (ImS) and the input control signals Hsync, Vsync, and MCLK and image-processes the image signal (ImS) according to operating conditions of the display panel 110 and the data driver 130. The signal controller 140 also receives a luminance compensating value from the luminance compensator 150 and changes the image signal (ImS) according to the luminance compensating value to compensate luminance. A method for compensating luminance will be further described below.

The signal controller 140 generates a data control signal CONT1 for controlling the data driver 130 and transmits both CONT1 and the image-processed image data signal (DATA) to the data driver 130. The signal controller 140 also transmits a scan control signal CONT2 for controlling the scan driver 120 to the scan driver 120.

A photographing unit 200 photographs an image generated by the display panel 110 of the manufactured display device 100. To compensate luminance on the respective pixels of the display panel 110, the display device 100 displays a test image on the display panel 110. Here, the test image for compensating luminance may be a red (R) image of which an entire screen image has a first gray, a green (G) image of which an entire screen image has a second gray, and a blue (B) image of which an entire screen image has a third gray. The photographing unit 200 photographs the test image and transmits photographed data to the luminance compensator 150. The photographing unit 200 is installed during a manufacturing process, is separated from the display device 100, and may be realized with a CCD camera.

The luminance compensator 150 receives the photographed data from the photographing unit 200, and uses the photographed data to calculate luminance compensating values of the respective pixels. The luminance compensator 150 stores a normal or baseline photographed data value corresponding to the test image, and the normal photographed data value is designated as reference data, i.e. baseline or reference luminance values for each pixel. Therefore, the luminance compensator 150 compares this reference data to the actual photographed data provided by the photographing unit 200, and calculates a luminance compensating value according to the difference between the two. The above-calculated luminance compensating value may be stored in an additional memory (not shown).

For example, for the R test image with a first gray, the luminance compensator 150 sets the luminance compensating value to be higher when a photographed data value of a predetermined pixel is less than the reference photographed data value. When the signal controller 140 receives a luminance compensating value that is set to be higher, the controller 140 sets an image signal of the corresponding pixel to be higher than the input image signal (Ims) so as to compensate the luminance value of the corresponding pixel.

The luminance compensator 150 additionally determines luminance compensating values according to a degree of curvature of the display panel 110. A method for setting a luminance compensating value will be described in detail with reference to FIG. 2 to FIG. 6.

The display panel 110 will now be described with reference to FIG. 2.

Figure 2:
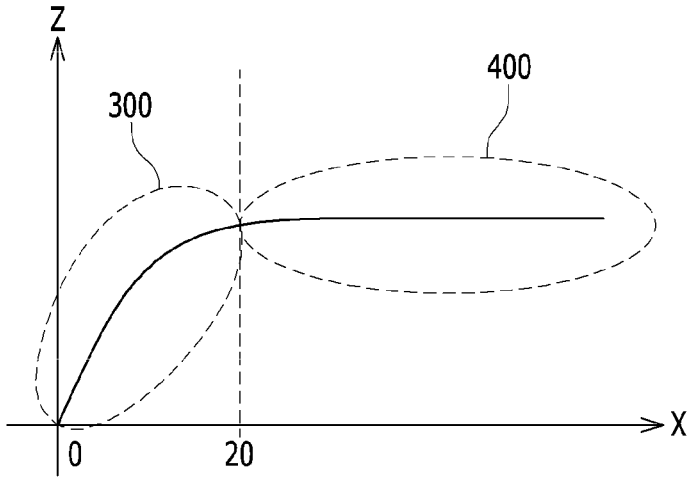
FIG. 2 illustrates the curvature of an upper surface of a display panel according to an exemplary embodiment of the present invention.

FIG. 2 shows a top plan view of a curvature configuration of a display panel 110 according to an exemplary embodiment of the present invention. That is, FIG. 2 shows the profile of the upper surface of display panel 110.

As shown in FIG. 2, the display panel 110 includes a flat portion 400 and a curved portion 300. The flat portion 400 has a substantially flat or planar configuration in which a portion where the image is displayed is flat.

The curved portion 300 has an image displaying portion that is not flat but instead has a constant curvature. It should be noted, however, that embodiments of the invention also contemplate curved portions 300 in which the curvature is not constant, but rather can vary in any manner.

Figure 3:
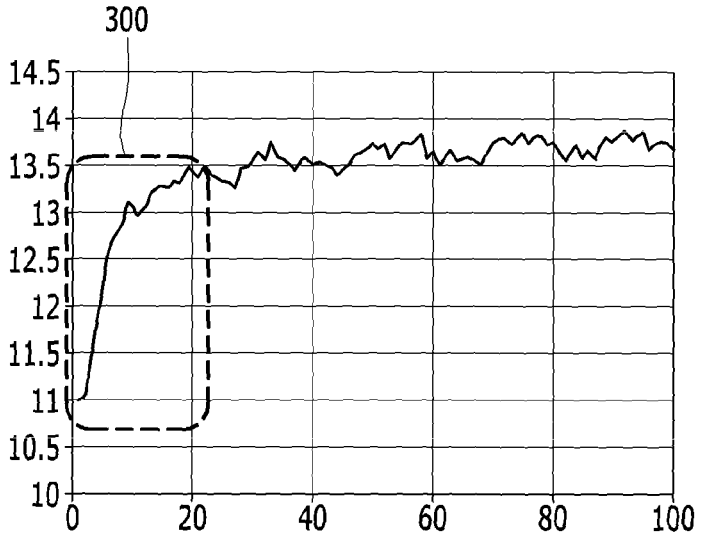
FIG. 3 shows data from a photographing unit according to an exemplary embodiment of the present invention.

The photographing unit 200 photographs the test image displayed on the display panel 100. The photographed data taken by the photographing unit 200 may be distorted because of the curved configuration of the display panel 110. FIG. 3 shows distortion of the photographed data.

FIG. 3 shows photographed data from a photographing unit 200 according to an exemplary embodiment of the present invention. Referring to FIG. 3, a horizontal axis represents a position of the panel, and in detail, the range $0 \leq X \leq 20$ shows curved portions and $X > 20$ shows the flat portion 400. The vertical (Z) axis shows distortion of the photographed data corresponding to the position of the panel.

The photographed data corresponding to the curved portion 300 of the panel are distorted because of the curvature of the panel. That is, a distance to the curved portion 300 of the panel from the photographing unit 200 is greater than a distance to the flat portion 400 from the photographing unit 200, so that more light from the flat portion 400 reaches the photographing unit 200 than light from the curved portion 300. Accordingly, the magnitude of the photographed data corresponding to the curved portion 300 is smaller. The photographed data corresponding to a portion with great curvature or an end portion of the curved portion 300 may not be reliable.

The luminance compensator 150 additionally compensates distortion of the photographed data caused by the curved configuration of the display panel 110. A method for compensating distortion of photographed data caused by a curved configuration of the panel will be described with reference to FIG. 4 to FIG. 6.

To compensate the above-noted distortion of the photographed data, a luminance compensating value ($P_{offset}$) is set based upon a curvature radius r applied to the corresponding panel, according to Equation 1.

$$p_{offset} = -\sqrt{r^2 - (n - L)^2} + r \qquad \text{(Equation 1)}$$

Here, the $P_{offset}$ value is a luminance compensating value for a curved portion of a display, r is a curvature radius, L is a size of a curved region (or a curved pixel area), and n is 1, 2, 3, 4, . . . , L.

Referring to Equation 1, r and L are fixed values and n is a variable describing the position of the curved portion. For example, referring to FIG. 3, when L is substantially 20 and n is 0 to 20, the curve luminance compensating value $P_{offset}$ offset may be calculated.

Referring to Equation 1, it is found that the curve luminance compensating value ($P_{offset}$) approaches 0 as n approaches L (i.e., a curved portion near a flat portion), but increases as n approaches 0 (i.e., the more the curved portion becomes distant from the flat portion). It is also found that the curve luminance compensating value ($P_{offset}$) becomes greater as the curvature radius is reduced.

Figure 4:
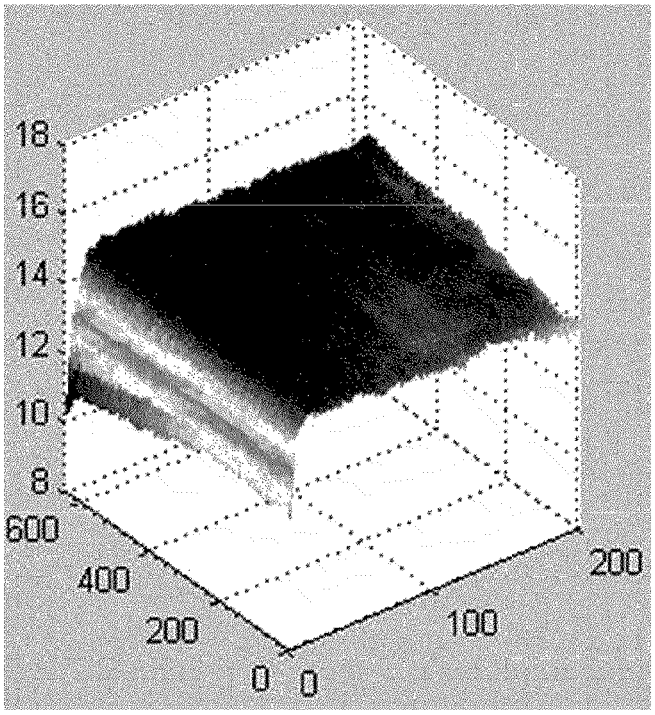
FIG. 4 shows distorted data before a curved panel is corrected.
Figure 5:
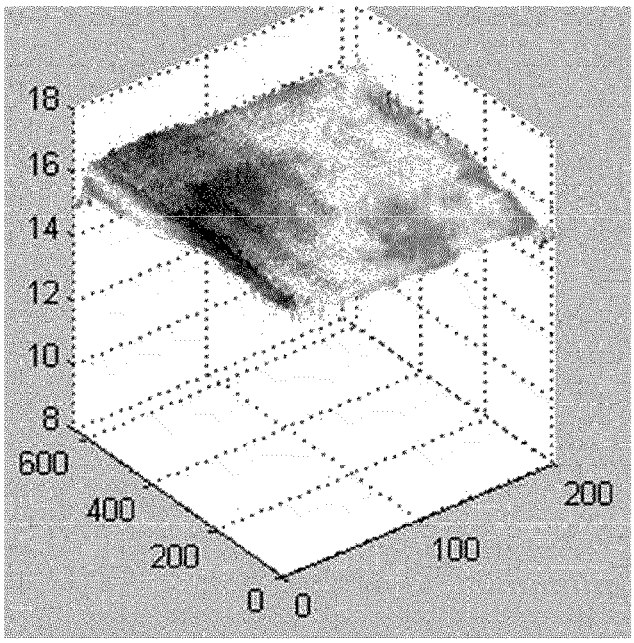
FIG. 5 shows corrected data after a correction.

When the curve luminance compensating value ($P_{offset}$) is found from Equation 1 and is applied to the existing distorted data shown in FIG. 4, a result shown in FIG. 5 is achieved.

FIG. 4 shows distorted data before the image data displayed on a curved panel is corrected and FIG. 5 shows image data after correction.

As shown in FIG. 4, to compensate data distortion of the curved portion provided on the left, when a luminance compensating value corresponding to this curved region is found using Equation 1 and is applied to the corresponding data, corrected data may be seen as shown in FIG. 5.

It has been described in the above-described exemplary embodiment of the present invention that the curved portion has one curvature (or one curvature radius), but the present invention is not restricted thereto, and the curved portion may instead have a plurality of curvature portions (respective portions with different curvature radii). In this case, the curvature radius is set to become greater when approaching to the flat portion, and it is set to be less when becoming distant therefrom.

The luminance compensating value of a curvature portion with a small curvature radius is set to be greater than the luminance compensating value of a curvature portion with a large curvature radius. In addition, in the case of a curvature portion with a constant curvature radius, a greater luminance compensating value is set as the position becomes more distant from the flat portion.

Figure 6:
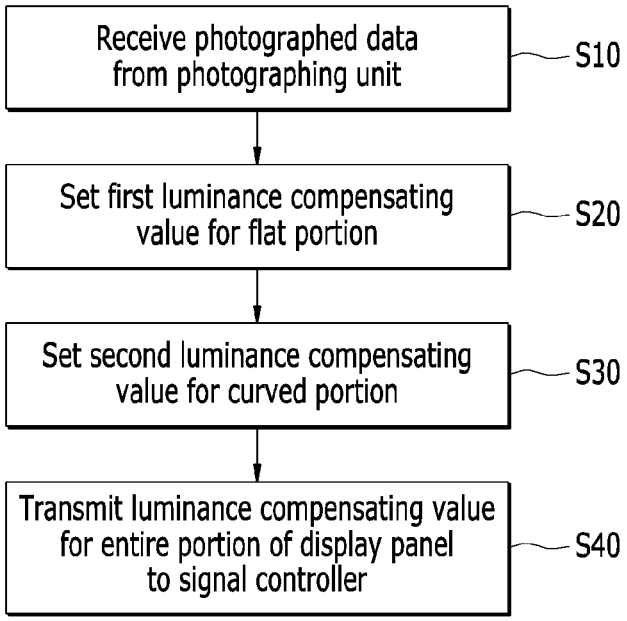
FIG. 6 shows a flowchart of a method for compensating luminance by a luminance compensator according to a first exemplary embodiment of the present invention.

A method for compensating luminance by a luminance compensator 150 according to an exemplary embodiment of the present invention will now be described with reference to FIG. 6.

The photographing unit 200 photographs substantially the entire display panel 110 to generate photographed data, and the luminance compensator 150 receives the photographed data (S10).

The luminance compensator 150 sets a luminance compensating value for the flat portion 400 (S20). That is, the luminance compensator 150 compares the photographed data corresponding to the flat portion 400 to the reference photographed data, and sets a first luminance compensating value for the flat portion 400.

The luminance compensator 150 sets a luminance compensating value for the curved portion 300 according to Equation 1 (S30). That is, the luminance compensator 150 sets a curve luminance compensating value according to the photographed data corresponding to the curved portion 300 and a degree of separation from the flat portion. The curve luminance compensating value of the curved portion near the flat portion is set to have a smaller value than that for the curved portion that is distant from the flat portion.

The luminance compensator 150 transmits luminance compensating values for the entire portions 300 and 400 of the display panel 110 to the signal controller 140 (S40). That is, the luminance compensator 150 transmits the first luminance compensating value for the flat portion 400 that is set in S20 and the second luminance compensating value for the curved portion 300 that is set in S30 to the signal controller 140. The signal controller 140 changes the image signal (ImS) according to the luminance compensating value provided by the luminance compensator 150, by which the luminance is finally compensated.

As described above, a method for compensating luminance by the luminance compensator 150 according to an exemplary embodiment of the present invention may use an existing plane photographing scheme for optically compensating the plane and may also compensate luminance of the curved portion, thereby quickly and accurately correcting the distortion generated on the curve in a relatively straightforward manner, and incurring no additional processing cost.

It has been described in the exemplary embodiment that the display panel 110 has a convex curvature configuration with reference to the photographing unit 500 as shown in FIG. 2. However, the above-described method for compensating luminance is applicable to other curvature configurations, such as those in which the display panel 110 is concave with reference to the photographing unit 500.

The concave curvature panel configuration corresponds to a convex curvature panel configuration except that the photographed data value becomes different. As this is known to a person skilled in the art, no detailed description thereof will be provided.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims. Furthermore, different features of the various embodiments, disclosed or otherwise understood, can be mixed and matched in any manner to produce further embodiments within the scope of the invention.

What is claimed is:

1. A curved display device, comprising:

a display panel including a curved portion and a flat portion;

a luminance compensator configured to determine a first luminance compensating value for the flat portion and to determine a second luminance compensating value for one or more positions of the curved portion; and a signal controller for adjusting an input image signal corresponding to the first and second luminance compensating values set by the luminance compensator so as to compensate luminance of those portions of the input image signal corresponding to both the curved portion and the flat portion of the display panel, and for transmitting the compensated image signal to the display panel;

wherein the second luminance compensating value is determined according to:

$$p_{offset} = -\sqrt{r^2 - (n - L)^2} + r$$

where a $P_{offset}$ value is a second luminance compensating value corresponding to a position on the display panel, r is a curvature radius of the curved portion, L is a size of the curved portion, n is an integer corresponding to the position on the display panel and having a value between 1 and L, and n decreases from L to 0 with increasing distance from the flat portion of the display panel.

2. The curved display device of claim 1, wherein:

the luminance compensator is configured to receive data derived from an image captured by a photographing unit, and to determine the second luminance compensating value according to the data corresponding to the curved portion and a radius of curvature of the curved portion.

3. The curved display device of claim 1, wherein:

a radius of curvature of the curved portion is substantially constant across the curved portion.

4. The curved display device of claim 3, wherein:

the second luminance compensating value has a first value corresponding to that part of the curved portion that is proximate to the flat portion, and has a second value corresponding to that part of the curved portion that is remote from the flat portion, the second value being greater than the first value.

5. The curved display device of claim 1, wherein:

the curved portion includes a first portion having a first radius of curvature and a second portion having a second radius of curvature, the first radius of curvature being greater than the second radius of curvature, and wherein the first portion is positioned closer to the flat portion than the second portion.

6. The curved display device of claim 5, wherein:

the second luminance compensating value comprises a first value corresponding to the first portion and a second value corresponding to the second portion, the first value being less than the second value.

7. The curved display device of claim 6, wherein:

determined ones of the second luminance compensating value increase with corresponding distance from the flat portion.

8. A method for driving a curved display device, the device including a display panel with a curved portion and a flat portion and a driver for driving the display panel, the method comprising:

setting a first luminance compensating value corresponding to the flat portion;

setting a second luminance compensating value corresponding to respective positions of the curved portion;

adjusting an input image signal according to the first luminance compensating value and the second luminance compensating value, so as to form an adjusted image signal; and applying the adjusted image signal to the display panel;

wherein the second luminance compensating value is determined according to:

$$p_{offset} = -\sqrt{r^2 - (n - L)^2} + r$$

where a $P_{offset}$ value is a second luminance compensating value corresponding to a position on the display panel, r is a curvature radius of the curved portion, L is a size of the curved portion, n is an integer corresponding to the position on the display panel and having a value between 1 and L, and n decreases from L to 0 with increasing distance from the flat portion of the display panel.

9. The method of claim 8, wherein:

the setting a second luminance compensating value includes:

receiving data determined from a photographing of the display panel by a photographing unit; and setting the second luminance compensating value according to the data corresponding to the curved portion and according to a radius of curvature of the curved portion.

10. The method of claim 8, wherein:

a radius of curvature of the curved portion is substantially constant across the curved portion.

11. The method of claim 10, wherein:

the second luminance compensating value has a first value corresponding to that part of the curved portion that is proximate to the flat portion, and has a second value corresponding to that part of the curved portion that is remote from the flat portion, the second value being greater than the first value.

12. The method of claim 8, wherein:

the curved portion includes a first portion having a first radius of curvature and a second portion having a second radius of curvature, the first radius of curvature being greater than the second radius of curvature, and wherein the first portion is positioned closer to the flat portion than the second portion.

13. The method of claim 12, wherein:

the second luminance compensating value comprises a first value corresponding to the first portion and a second value corresponding to the second portion, the first value being less than the second value.

14. The method of claim 13, wherein:

determined ones of the second luminance compensating value increase with corresponding distance from the flat portion.

* * * * *